US009474920B1

(12) United States Patent
Fewel et al.

(10) Patent No.: US 9,474,920 B1
(45) Date of Patent: Oct. 25, 2016

(54) FIRE EXTINGUISHER SYSTEM AND METHOD FOR EXTINGUISHING FIRES

(75) Inventors: Heath Fewel, Camas, WA (US); Matthew A. Marger, Beaverton, OR (US); Bryce McHale, Wixom, MI (US)

(73) Assignee: CEASE-FIRE, LLC, Vancouver, WA (US)

( * ) Notice: Subject to any disclaimer, the term of this patent is extended or adjusted under 35 U.S.C. 154(b) by 0 days.

(21) Appl. No.: 12/547,324

(22) Filed: Aug. 25, 2009

Related U.S. Application Data

(63) Continuation of application No. 10/883,473, filed on Jun. 30, 2004, now abandoned.

(60) Provisional application No. 60/485,046, filed on Jul. 3, 2003.

(51) Int. Cl.

| | |
|---|---|
| ***A62C 2/00*** | (2006.01) |
| ***A62C 37/08*** | (2006.01) |
| ***A62C 35/00*** | (2006.01) |
| ***A62C 35/68*** | (2006.01) |
| ***A62C 3/08*** | (2006.01) |

(52) U.S. Cl.
CPC *A62C 35/68* (2013.01); *A62C 3/08* (2013.01)

(58) Field of Classification Search
CPC ..... A62C 35/68; A62C 99/0018; A62C 3/08
USPC ..... 169/47, 6, 5, 37, 46, 44; 252/3, 8, 8.05
See application file for complete search history.

(56) References Cited

U.S. PATENT DOCUMENTS 2,871,952 A * 2/1959 Doak ..... 169/26
3,010,815 A * 11/1961 Pierce et al. ..... 149/22
3,645,338 A * 2/1972 Livingston ..... 169/16
3,669,191 A * 6/1972 Livingston ..... 169/45
3,722,596 A * 3/1973 Livingston ..... 169/60
3,779,317 A * 12/1973 Livingston ..... 169/47
4,007,878 A * 2/1977 Anderson ..... 239/209
4,464,267 A * 8/1984 Chiesa et al. ..... 252/8.05
4,770,251 A * 9/1988 Sweet ..... 169/37
4,791,993 A * 12/1988 Curran ..... 169/16
4,859,349 A * 8/1989 Clark et al. ..... 252/3
5,026,735 A * 6/1991 Stern ..... 521/50
5,053,146 A * 10/1991 Yamaguchi ..... 252/2
5,678,231 A * 10/1997 Mouk et al. ..... 588/1
5,833,874 A * 11/1998 Stewart et al. ..... 252/8
5,884,710 A * 3/1999 Barnes et al. ..... 169/46
5,894,892 A * 4/1999 Huang ..... 169/36
5,909,776 A * 6/1999 Stewart et al. ..... 169/26
5,915,479 A * 6/1999 Ponte ..... 169/46
6,024,889 A * 2/2000 Holland et al. ..... 252/5

(Continued)

*Primary Examiner* — Arthur O Hall
*Assistant Examiner* — Steven M Cernoch
(74) *Attorney, Agent, or Firm* — Marger Johnson

(57) ABSTRACT

A system for extinguishing fires is provided which is compliant with ANSI/UL 1254 1999. The system comprises a fire extinguishant liquified gas which is EPA compliant, an ammonium fire extinguishing material, a polymeric gelling agent that interacts with fire extinguishing substances (a) and (b) to promote the formation of a stable, gel-like suspension there between, and a viscosity reducing agent which facilitates the flow of the mixed phase agent from the extinguisher so that a sufficient amount of the fire extinguishing substances (a) and (b) is discharged from the system in response to heat generated by a fire in an area proximate to said fire extinguisher system to extinguish the fire in a manner compliant with ANSI/UL 1254 1999.

22 Claims, 1 Drawing Sheet

(56) References Cited

U.S. PATENT DOCUMENTS 6,056,063 A * 5/2000 Hung ..... 169/28
6,095,251 A * 8/2000 Mitchell et al. ..... 169/43
6,581,878 B1 * 6/2003 Bennett ..... 244/136
2003/0198775 A1 * 10/2003 Roth et al. ..... 428/68

* cited by examiner

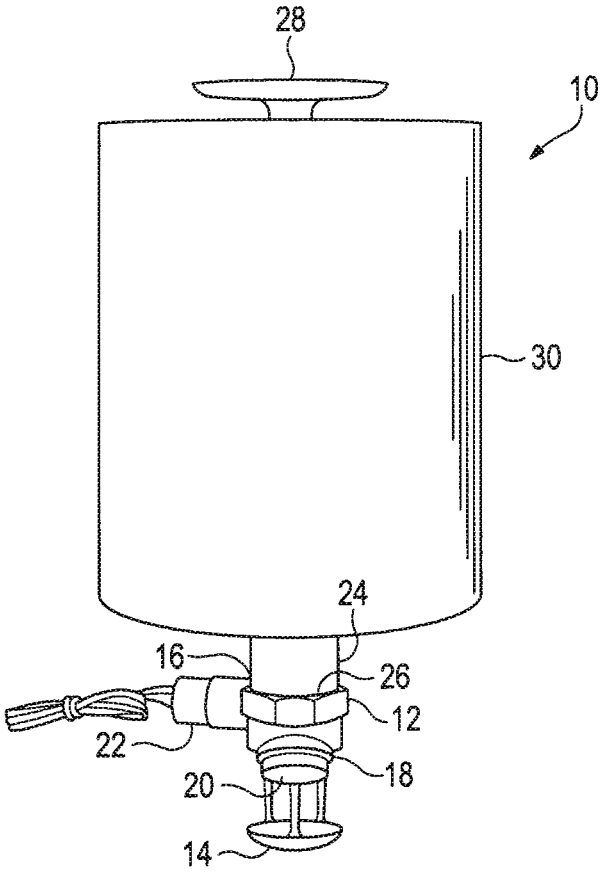
28
10
30
24
16
26
12
22
18
20
14

FIRE EXTINGUISHER SYSTEM AND METHOD FOR EXTINGUISHING FIRES

CROSS-REFERENCE TO RELATED APPLICATIONS

This application is a continuation of prior U.S. patent application Ser. No. 10/883,473, filed Jun. 30, 2004, now abandoned, which claims the benefit of U.S. Provisional Patent Application No. 60/485,046, filed Jul. 3, 2003. Both of these related applications are hereby incorporated herein by reference.

BACKGROUND OF THE INVENTION

Fire extinguisher systems that use a liquefied extinguishant gas to disseminate a fire suppressing powder offer substantial advantages over traditional technologies. The simultaneous application of two modes of fire suppression produces a synergy that results in a substantial improvement in efficacy over single-phase systems. As a result, the area coverage provided by a mixed phase extinguisher is significantly greater than that provided by a single-phase extinguisher of the same size.

The development of a fire extinguisher system which uses an extinguishant liquefied gas and a fire suppressing powder presents a number of technical challenges. These include the development of a formulation which is not subject to packing or clogging, which is compliance with US EPA requirements regarding ozone depleting substances, and which has the general physical design of a compact conventional extinguisher.

Mixed agent fire suppression systems which combine two modes of fire suppression in a single system can achieve a greater efficiency than conventional systems. First developed in the early 1980's, these fire extinguishers typically contain a blend of a chlorofluorocarbon (Halon) based fire suppressant gas/liquid and a monoammonium phosphate (MAP) based powder along with a vinyl gelling agent (Carbopol). Halons such as Halon 1301 (trifluorochoromethane) and Halon 1211 (difluorochlorobromomethane) have been employed for this purpose. These agents were combined to form a stable, highly efficient fire-fighting gel. Because the fire suppression mechanism of each individual agent compliments the other, a smaller quantity of the blended agent is required than would be needed for either single agent system. An example of the composition that could be employed for this purpose is set forth in U.S. Pat. No. 4,652,383, which is incorporated herein by reference.

Since the units are pre-engineered and self-contained, they can provide fire protection in areas where it is not practical to run a network of piping. Installation of a network of piping to facilitate fire protection is extremely costly and some cases not functionally possible.

The mixed phase systems provide much easier clean up than many other fire suppression products. Aqueous-based fire suppression units, such a water sprinkler systems, result in severe water damage to the protected area. 70% or more of the costs of insurance claims are attributable to water damage following a fire suppression event. The dry powder residue formed in the suppression of fires employing the mixed phase system of the present invention is easily vacuumed, making the system an attractive alternative for applications in which water or chemical damage is an issue.

In 1988, the Montreal Treaty phased out the production of chlorobromofluorocarbons and chlorofluorocarbons, including the Halon agents used in the mixed-phase extinguisher systems. These compounds were found to promote damage to the ozone layer of the atmosphere and thus threaten human health by increasing exposure to ultraviolet radiation.

Over the past several years, certain ozone safe alternatives to Halon have been developed. These new compounds differ from those they replace in a number of fundamental ways. The formation of a stable, free-flowing suspension depended on the specific molecular interaction of the powder, liquid, and the gelling agents. It was found that simply replacing the Halon in the original formula with one of the new compounds would not necessarily work. Furthermore, changes in the physical properties of the extinguishant-liquefied gas had a significant adverse effect on the discharge properties of the extinguisher device.

Therefore, a new mixed phase fire suppression agent composition for delivering same needed to be developed using only Underwriters Laboratory ("UL") acceptable components. Furthermore, the current UL specifications required for compliance are far more stringent. Thus, it is necessary to deploy an extinguisher system that meets the appropriate UL specifications. It has been determined that every element of a formula composition and extinguisher design is critical to the development of a unit which meets the rigorous requirements of the UL specifications. An extinguisher employing a mixed phase agent must be subjected to fire tests as per the Underwriters Laboratories specification 1254 for dry chemical extinguishers. Fire tests are performed in order to assure and certify the performance characteristics of these extinguisher systems.

Mixed-phase fire suppression technology provides substantive advantages over conventional systems. If they were available, extinguishers which are EPA compliant could make possible a variety of practical fire suppression applications.

SUMMARY OF THE INVENTION

It has also been found that in spite of new environmental requirements, mixed-phase technology can be a viable alternative to conventional modes of fire suppression. The agent is preferably a free-flowing liquid. The degree of settling of the powder components from the agent mixture should be controlled to maintain a liquid-like composition. Agitation may be required to return the mixture to a liquid-like state. A biphasic mixture which easily reliquifies with minimal agitation is said to be thixotropic. It is this property that is a key to the success of the subject agent.

The mixed phase agent system of this invention satisfies the requirements of UL 1254 specification for Total Flooding applications in large volume spaces. The subject system preferably comprises (a) a fire extinguishant liquified gas, (b) an ammonium fire extinguishing material, (c) a polymeric gelling agent, and (d) an viscosity reducing agent which facilitates the flow of the mixed phase agent from the extinguisher so that a sufficient amount of fire extinguishing substances (a) and (b) are discharged from the fire extinguisher system so that they contact the fire and extinguish same.

It has been determined that mixed phase units are much more efficient than pure halocarbon systems per se. For example, seventeen pounds of the mixed phase agent system provides fire suppression equivalent to 27 pounds of pure halocarbon. A lower concentration of agent reduces the risk of toxicity associated with halocarbon degradation products. Additionally, the presence of an ammonium fire extinguishing material greatly reduces the formation of hydrogen fluoride, a toxic, corrosive byproduct of halocarbon fire extinguishment. Mixed phase units are therefore a safer option for protection of inhabited spaces.

The mixed phase agent of the present invention uses EPA compliant compounds. The first of these compounds is a fire extinguishant liquified gas. Preferably, a fluoroalkane composition can be employed since it is approved by the EPA as the replacement for the now banned Halon (CFC-1211 and CFC-1301). More preferably, a fluoropropane is used in the subject mixed phase agent. Most preferably, a heptafluoropropane, such as Dupont FE-227, is utilized for this purpose.

A substantial problem with the use of fluoroalkanes per se is that they are significantly less effective than the banned Halon for suppressing fires. Additionally, fluoroalkanes differ significantly from the banned compounds on the molecular level.

The second suppressant compound employed in the mixed phase agent of this invention is an ammonium fire extinguishing material. This material can comprise a number compounds such as monoammonium phosphate, diammonium phosphate and/or triammonium phosphate. However, the preferred material for use herein is monoammonium phosphate. Conventional ABC powder is the most preferred material and typically includes more than 90% by weight monoammonium phosphate.

The formation of a stable, thixotropic gel is an important part of this invention. This involves working with specialized chemicals known as gelling agents, which are proprietary additives that interact with both the fire extinguishant liquified gas and the ammonium fire extinguishing material. These gels, when used in the proper ratio, promote the formation of a stable, gel-like suspension between two normally immiscible substances, i.e., the fire extinguishant liquified gas and the ammonium fire extinguishing material. A polymeric gelling agent is the preferred gelling agent for this purpose. More preferably, a vinyl polymer gelling agent such as Carbopol can be employed. For example, a Carbopol 940 product manufactured by the B.F. Goodrich Company.

Typically, a viscosity reducing agent be employ which facilitates the flow of the mixed phase agent from the extinguisher so that a sufficient amount of above-described fire extinguishing substances are discharged from the fire extinguisher system so that they contact the fire and extinguish same. Preferably, this product is a fine powder in the form of microscopic glass spheres. Because they are hollow, the glass bubbles have an extremely low density. Thus, they lower the density of the overall mixture and may inhibit packing and settling of the powdery components of the agent. The smooth, spherical shape of the bubbles lowers the viscosity of the agent and promotes better discharge performance. More preferably, a K1 grade product is used which is rated to withstand 200 psi of applied pressure, and has a size distribution of approximately 10 to 100 microns. 3M Scotchlite glass bubbles are the most preferred product for this use.

When the components of the mixed phase fire suppression agent have been completely added into the work space of the fire extinguisher device, a pressurized inert gas, such as nitrogen or the like, can be introduced. The purpose of this is to pressurize the fire suppression system to facilitate optimum discharge of the fire suppressing ingredients so that the fire will be completely stifled. Pressures measure within the confines of the system are maintained at preferably at least about 150 psi, more preferably at least about 160 psi, most preferably at least about 175 psi.

The dry powder agent component comprises (b) an ammonium fire extinguishing material, (c) a polymeric gelling agent, and (d) a viscosity reducing agent. The % weight of dry powder agent (b)-(d) in the total mixed phase fire suppression agent composition (a)-(d) can be 35-50% by weight, preferably 38-50% by weight, more preferably 40-48% by weight, and more preferably 42-46% by weight.

The mixed phase fire suppression agent composition preferably comprises 50-65%, more preferably 52-60%, and most preferably 54-58% by weight of (a) a fire extinguishant liquified gas, 35-50% by weight, more preferably 38-48% by weight, and more preferably 40-45% by weight of (b) an ammonium fire extinguishing material, 0.5-2.0%, more preferably 0.6-1.5%, and most preferably 0.75-1.2% by weight of (c) a polymeric gelling agent, and 0.5-2.0%, more preferably 0.6-1.5%, and most preferably 0.75-1.2% by weight of (d) a viscosity reducing agent.

The halocarbon/powder blend provides better circulation of the agent than pure powder systems. This allows the units to successfully meet the UL 1254 specification for Total Flooding applications in large volume spaces. These units can therefore be used in place of powder-only units in applications which require a certified product.

The extinguisher systems of the present invention have been certified according to Underwriters Laboratories specifications. These are typically modular systems which are completely self-contained and pre-engineered. Electrical connections are unnecessary, piping is not required, and the units can be easily moved as the need changes. Prior to the subject extinguisher system, no discrete, dry chemical extinguisher unit had received UL 1254 certification from any official certifying organization.

It has been shown that the increased efficiency of this mixed phase system provides a fire suppressing capacity which can successfully meet the UL 1254 standard, even in large volume spaces for Class A, B and C fires. Therefore, the systems are ideal for occupied or unoccupied areas such as computer equipment rooms, telecommunications areas, power or electrical areas, flammable liquid areas, temporary construction sites and areas that require sensitive yet powerful fire protection such as museums, data and record storage locations and wine rooms. It is an outstanding system in places where water cannot be employed for fire extinguishing purposes.

In use, the extinguisher system of the present invention is actuated by heat generated by a fire in the area which reaches a predetermined temperature. This activates a temperature actuator in the extinguisher system causing the mixed phase agent system located in the therein in the form of stable, thixotropic gel to be discharged therefrom under pressure as a dual phase dry chemical fire suppressant which stifles the fire. In compliance with the requirements of UL 1254, and in order to suppress chemical fires which may be present at elevated heights relative to the ceiling of given enclosure, when the extinguisher system of this invention is attached to the ceiling, the trajectory of the dual phase dry chemical fire suppressant emitted by system is directed upwardly so it preferably reaches a height at least equal to the lowest point of the extinguisher system, more preferably to a point at least about 6" above the lowest point of the extinguisher system, and most preferably to a point at least about 9" above the lowest point of the extinguisher system. The most recent requirements of UL 1254 prescribe for the extinguishment by the extinguisher system being tested of a container of burning heptane located 6" from the ceiling of the test enclosure.

In use, a method is provided for extinguishing fires which is compliant with Underwriter Laboratories testing procedure Class Number ANSI/UL 1254 1999 ("ANSI/UL 1254"). The method comprises providing a fire extinguishing system which is compliant with ANSI/UL 1254 1999. As stated above, the system preferably includes (a) a fire extinguishant liquified gas which is EPA compliant, (b) an ammonium fire extinguishing material, (c) a polymeric gelling agent that interacts with fire extinguishing substances (a) and (b) to promote the formation of a stable, gel-like suspension thereof, and (d) a viscosity reducing agent which facilitates the flow of the mixed phase agent from the extinguisher so that a sufficient amount of the fire extinguishing substances (a) and (b) is discharged from the fire extinguisher system to extinguish a fire. A sufficient amount of fire extinguishing substances (a) and (b) are discharged from the fire extinguisher system in response to heat generated by a fire in an area proximate to the fire extinguisher system, the fire extinguishing substances (a) and (b) extinguishing the fire in a manner compliant with ANSI/UL 1254 1999.

The system for extinguishing fires, which is compliant with ANSI/UL 1254 1999, comprises a fire extinguishing system container which is compliant with ANSI/UL 1254 1999 for storing and discharging a mixed phase agent system for extinguishing fires. Also, it includes a mixed phase agent system located within the container which preferably comprises components (a)-(d) described above. Also, it generally includes an apparatus for directing the trajectory of the fire extinguishing substances (a) and (b) from the fire extinguisher system, to extinguish a fire is directed upwardly so it reaches a height at least equal to the lowest point of the extinguisher system, when the fire extinguishing substances (a) and (b) are discharged from the fire extinguisher system container in response to heat generated by a fire in an area proximate to the fire extinguisher system. The fire extinguishing substances (a) and (b) extinguish the fire in a manner compliant with ANSI/UL 1254 1999.

The container preferably includes attachment member for affixing the fire extinguishing system at an elevated height in an enclosure. The container comprises a substantially cylindrical shape, more the container comprises a substantially cylindrical shape with a substantially rounded bottom portion.

The apparatus for directing the flow trajectory of the fire extinguishing substances (a) and (b) from the fire extinguisher system preferably comprises a concave-shaped member extending outwardly from the fire extinguisher container. The system preferably further includes a heat-activated apparatus for discharging fire-extinguishing substances (a) and (b) in response to heat generated by the fire in an area proximate to the fire extinguisher system.

The fire extinguishing substances (a) and (b) discharged from the fire extinguisher system container are preferably non-toxic. Also, the system of the present invention preferably extinguishes fires in chemical materials and/or extinguishes fires in wood.

DRAWING OF A PREFERRED EMBODIMENT

FIG. 1 is a perspective view of the system for extinguishing fires which is compliant with ANSI/UL 1254 1999 of the present invention.

DETAILED DESCRIPTION OF A PREFERRED EMBODIMENT

The following describes the components of a preferred system 10 for extinguishing fires which is compliant with ANSI/UL 1254 1999, which is depicted in FIG. 1, namely, the Model CFF 800 hybrid agent dry chemical automatic extinguishing system manufactured by Cease Fire, LLC ("Model CFF 800"):

| No. | Description | Manufacturer | Part Number |
|---|---|---|---|
| CF-600 | DDI Cylinder | DDI seamless | CF-11308 |
| CF-700 | Coupling | Fastenal | 10060689 |
| CF-800 | 0-ring | Maryland Metrics | 10999-04777 |
| CF-900 | Sprinkler Head (155F) | Viking | 09679AB |
| CF-930 | Sprinkler Head Guard | Fastenal | 10888-0481 |
| CF-1000 | 45 Degree Elbow | Fastenal | 440079-131280 |
| CF-1100 | Tank Valve | Shrader-Bridgeport | 8090680047 |
| CF-1200 | Pressure Switch Normally closed/120 | Nason | SM-2C-95F/WLAU |
| CF-1210 | Pressure Switch Normally closed/120 | Nason | SM-2C-120F/WLAU |
| CF-1300 | Brass Plug | Astenal | 440012-131280 |
| CF-1400 | Pressure Gauge | Dresser Measurements | 711A036-01 |
| CF-1900 | Hanger Flange (DDI) | Fastenal | 10888-04788 |

General Assembly Instructions for Model CFF 800

1. Provide one each of a Coupling 12, Sprinkler Head 14, Tank valve 16, 45 Degree Elbow 18, Pressure Switch 22, Pressure Gauge 20 and Plug 24.
2. Apply thread lock material to all threaded components and let dry for 24 hours. Reapply thread lock material and let dry for 20 minutes.
3. Place Coupling 12 in vise, and attach Sprinkler Head 14.
4. Remove assembly from vise.
5. Place O-ring 26 on Coupling 12.
6. Fill Cylinder 30 with powder mix. Cylinder 30 includes a Hanger Flange 28.
7. Attach Coupling 12, Sprinkler Head 14, O-ring 26 to Cylinder 30.
8. Attach Tank Valve 16, then plug, then Pressure Switch 22, then 45 Degree Elbow 18, then Pressure Gauge 20.
9. Charge unit with nitrogen.
10. Apply snoop to all threaded connections.
11. If no bubbles appear bleed nitrogen.
12. Fill with fire extinguishant liquified gas and charge with nitrogen.
13. Roll unit 5 times for 1 minute each recharge with nitrogen after each 1 minute roll, let unit set for 24 hours.
14. Repeat 13
15. Repeat 13

Production Instructions For Model CFF 800

| Major Production Equipment | Work Instruction | W.I. Number |
|---|---|---|
| Mettler Toledo Scale PS 60 | Powder Mix Prep | I |
| Charles Ross & Son Co. Ribbon Blender 42N-10 | Powder Mix | II |
| Quincy Compressor QTH-10-120, Flexicon Powder Transfer 1250, AMS Powder Filler A-110 | Powder Mix | III |
| Micromotion Coriolis Sensor/Transmitter Series, Haskel Pump DTN-4, Pelouze Scale 4040, PLC Quick Panel Jr., Quincy Compressor Qth-10-120 | Gas Fill | IV |
| Mettler Toledo Scale PS 60 | Final Weight Measurement | V |

-continued

| Production Instructions For Model CFF 800 | | |
|---|---|---|
| Major Production Equipment | Work Instruction | W.I. Number |
| Ashcroft Pressure Test Gauge Q-4907 | Final Pressurization/ Gelling | VI |
| Mettler Toledo Scale PS 60 | Final Inspection/ Final Weight | VII |

Work Instruction I

1. Monoammonium phosphate (MAP) in 50.0 lb bags. Therefore, there is no need to pre-measure the MAP.
2. Carbopol and Glass Spheres must be weighed to targeted measurements using scale in the Powder Mix Prep work cell. Zero out the scale before measuring the powder constituents to ensure that only powder is being weighed.
3. Enter all powder bath #, Carbopol weight, Glass Sphere weight, and MAP weight.

Work Instruction II

1. Prior to placing any powder constituents into the Powder mixer, place Hepa vacuum nozzle into the Powder Mix exhaust hood and turn on the vacuum. Vacuum level can be adjusted to minimize dust.
2. Place powder constituents into the mixer, one by one.
3. Turn on mixer.
4. After the mix has completed, shut down the mixer, and note the length of the mix.
5. Open the bottom of the mixer to approximately 25% open.
6. Turn the mixer on to fore the mixed powder constituents down into the hopper. This mixer should be left on long enough to fill the hopper adequately.

Work Instruction III

1. Make sure that power is turned on to the Powder Transfer System.
2. Place the Powder Transfer System in Forward Mode.
3. Fill Powder Filling Unit until the Powder transfer automatically shuts down.
4. Place product cylinder on Powder Fill Scale.
5. Place nozzle of Hepa vacuum in the side of the Powder Fill shroud, and turn on a light vacuum.
6. Initiate a powder fill.
7. After the powder filling complete, write down the result and verify that the result is in specification.

Work Instruction IV

1. Select the appropriate recipe on the PLC panel.
2. Connect the gas fill line to the canister.
3. Push the FILL button on the PLC panel.
4, Once the fill operation has reached the desired setpoint, the system will stop to allow the gas fill line to be disconnected from the canister.
5. Write the final weight.

Work Instruction V

1. Zero out the weight scale next to the Gas Filling station.
2. Place the product cylinder onto the scale and take a measurement.
3. Write down the weight of the product cylinder.

Work Instruction VI

1. Take the unit to the Final Pressurization work cell.
2. Roll the unit for approximately 1 minute (+−15 seconds, as per the Product Tracking Sheet specification.
3. Re-charge the cylinder with nitrogen to 175 psi.

Work Instruction VII

1. Take the unit to the Final Inspection work cell.
2. Weigh the unit. Note the weight.

Installation Instructions

CFF 800 Units were tested by Factory Mutual Research Corp. for "Total Flooding" of Class A, B and C fires. The area being protected should be a reasonably tighten closure where combined openings does not exceed one percent of the total surface area square footage.

CFF 800 Units must be hung vertically with the sprinkler deflector pointed downward. The unit is to be used in areas where the temperature falls between 32 degrees and 100 degrees Fahrenheit (0 to 38 degrees Celsius). Each Unit is to be mounted or attached to a secure ceiling for example; wood, metal, or concrete. Insure that there are no obstructions to the free flow operations of the Sprinkler Head and disbursement of the extinguishment within the enclosure. Do not mount on suspended ceiling or loose tiles.

The pressure switch on CFF 800 Units should be installed in accordance with national electrical codes, and any local requirements.

A: INTRODUCTION

An approval examination of business unit Model CFF 800 hybrid agent dry chemical automatic extinguishing system was conducted by FM Global. FM Approvals division of FM Global offers certification services to manufacturers of fire protection equipment. The examination of the Model CFF 800 hybrid agent dry chemical automatic extinguishing system was conducted by FM Approvals in accordance with the UL standard listed below:

Pre-Engineered Dry Chemical
Extinguishing System Units ANSI/UL 1254-1999 Aug. 31, 1999

B: DESCRIPTION

The Model CFF 800 automatic fire extinguishing system is for use in total flooding hazards. The Model CFF 800 is intended to protect enclosures with a maximum volume of 800 $ft^3$ (22.5 $m^3$) and a minimum volume of 512 $ft^3$ (14.5 $m^3$), for Class A, B and C fires. The Model CFF 800 is intended for use in enclosures with a maximum ceiling height of 12.2 ft. (3.7 m) and a minimum ceiling height of 8.0 ft. (2.4 m) and an area no greater than 67.2 $ft^3$ (6.2 $m^3$) and no greater than 8.2 ft (2.5 m) per side. The Model CFF 800 is intended for use in enclosures with no more than 2.5 $ft^2$ (0.2 $m^2$) of unclosable openings (1.0 percent of total surface area). The subject total flooding system is suitable for applications where the ambient operation temperature range is between 32° to 100° F. (0° to 38° c.). The Model CFF 800 is approved for usage when installed in the allowable enclosure in a pendant position no greater than 4.1 ft. (1.25 m) from any wall.

The Model CFF 800 automatic fire extinguishing system utilizes Monoammonium Phosphate (MAP) and FE-227 as extinguishing agents. Gaseous nitrogen is used to pressurize the Model CFF 800 to 175 psi (1,200 kpa) at 70° F. (21° C.).

C. EXAMINATION AND TESTS

1. Fire Test (ANSI/UL 1254-1999 Class A Section 25.2

Total Flooding Protection (0-5 Percent Unclosable Opening)-Fire testing was conducted to determine the maximum area and height that can be protected by the Model DFF 800 m with a 1.0 percent unclosable opening and minimum cylinder ambient storage temperature of 32° F. (0° C.). The wood crib fires were placed on a rolling track system, ignited exterior to the room, allowed to burn for 2 minutes and roll in the room. Considering the nature of the automatic discharge of the Model CFF 800, the wood cribs could not be ignited in the test enclosure an obtain the required preburn time. All of the fire tests described in Section 1 were performed at Western Fire center, Inc. of Kelso, Wash. The table below illustrates a summary of the essential test parameters and results.

| Test | ANSI/UL 1254-1999 Class A Section 25.2 |
|---|---|
| Room Dimensions (L × W × H}) | 8.2 ft × 8.2 ft. × 12.2 ft (2.5 m × 2.5 m × 3.7 m) |
| 1 percent opening (W × H) | 0.9 ft xx 2.8 ft. (0.3 m × 0.8 m) two walls |
| Unit Temperature | 32° f. (0.0° C.) |
| Unit Location | Center of ceiling in a pendent position |
| Fuel | 2 wood cribs, one each at the back and front walls |
| Pre Burn Time | 2:18 (min:sec.) (manual discharge) |
| Time to Extinguish from Discharge | 0:04 (min:sec.) |

The results were deemed acceptable to FM Approvals.

B. Fire Test (ANSI/UL 1254-1999 Class B Section 25.3)

Total Flooding Protection (0-5 Percent Unclosable Opening)-Fire testing was conducted to determine the maximum area and height that can be protected by the Model DFF 800 m with a 1.0 percent unclosable opening and minimum cylinder ambient storage temperature of 32° F. (0° C.). The 3 in (7.6 cm) diameter and were placed at all four corners of the room at floor level and ceiling level. Four additional cans were placed in the middle of each wall at floor level. The specific placements of the cans were assumed to be the worst-case scenario, considering the distribution of extinguishing agent when discharged. The table below illustrates a summary of the essential test parameters and results.

| Test | ANSI/UL 1254-1999 Class A Section 25.3 |
|---|---|
| Test Date | May 22, 2002 |
| Room Dimensions (L × W × H}) | 8.2 ft × 8.2 ft. × 12.2 ft (2.5 m × 2.5 m × 3.7 m) |
| 1 percent opening (W × H) | 0.9 ft xx 2.8 ft. (0.3 m × 0.8 m) two walls |
| Unit Temperature | 32° F. (0.0° C.) |
| Unit Location | Center of ceiling in a pendent position |
| Fuel | (12) 3 in. (7.6 cm) diameter cans with heptane |
| Pre Burn Time | 0:30 (min:sec.) (manual discharge) |
| Time to Extinguish from Discharge | 0:05 (min:sec.) |

The results were deemed acceptable to FM Approvals.

C Fire Test (ANSI/UL 1254-1999 Class B Sections 25.4, 26.4 and 26.5)

Total Flooding Protection (0-5 Percent Unclosable Opening)-Fire testing was conducted to determine that the Model CFF 800 can respond to, and extinguish a 2.5 $ft^2$ (0.2 $m^2$) pan fire in an automatic mode, with the maximum area and height enclosure and a minimum cylinder ambient storage temperature of 32° F. (0.0° C.). The pan was placed in the back right corner on the floor and a 1 $ft^2$ (0.09 $m^2$) unclosable opening was placed on the right wall, 6 in (5.1 cm) from the rear wall, at the height of the pan lip. A second 1 $ft^2$ (0.09 $m^2$) unclosable opening was placed on the left wall 6 in. (5.1 cm) down from the ceiling height and 6 in. from the back wall. The specific placement of the pan fire and the unclosable openings comply with ANSI/UL 1254-1999 and was assumed to be the worst case scenario. The table below illustrates a summary of the essential test parameters and results.

| Test | ANSI/UL 1254-1999 Class B Section 25.4, 26.4 and 26.5 |
|---|---|
| Room Dimensions (L × W × H}) | 8.2 ft × 8.2 ft. × 12.2 ft (2.5 m × 2.5 m × 3.7 m) |
| 1 percent opening (W × H) | 1.0 ft × 1.0 ft (0.3 m × 0.38 m) left and right walls |
| Unit Temperature | 32° F. (0.0° C.) |
| Unit Location | Center of ceiling in a pendent position |
| Fuel | (2.5 $ft^2$ (0.2 $m^2$) pan with heptane |
| Pre Burn Time | 0:44 (min:sec.) (automatic discharge) |
| Time to Extinguish from Discharge | 0:02 (min:sec.) |

The results were deemed acceptable to FM Approvals.

D. Fire Test (ANSI/UL 1254-1999 Class B Sections 26.6 and 26.7)

Total Flooding Protection (0-5 Percent Unclosable Opening)-Fire testing was conducted to determine that the Model CFF 800 can respond to, and extinguish a 2.5 $ft^2$ (0.2 $m^2$) pan fire in an automatic mode, with the maximum area and height enclosure and a minimum cylinder ambient storage temperature of 100° F. (38° C.). Additionally, the fire testing was conducted to determine that the Model CFF 800 can extinguish a 2.5 $ft^2$ (0.2 $m^2$) pan fire without any flame spread by splashing of the flammable liquid from the pan at a minimum mounting height of the unit. The pan was placed in the center of the room and the two 1 $ft^2$ (0.09 $m^2$) unclosable openings were in the same position as testing in section 3.3. The specific placement of the pan fire and the unclosable openings comply with ANSI/UL 1254-1999 and was assumed to be the worst case scenario. The table below illustrates a summary of the essential test parameters and results.

| Test | ANSI/UL 1254-1999 Class B Section 26.6 and 26.7 |
|---|---|
| Test Date | May 22, 2002 |
| Room Dimensions (L × W × H}) | 8.2 ft × 8.2 ft. × 12.2 ft (2.5 m × 2.5 m × 3.7 m) |
| 1 percent opening (W × H) | 1.0 ft × 1.0 ft (0.3 m × 0.3 m) left and right walls |
| Unit Temperature | 100° f. (38° C.) |
| Unit Location | Center of ceiling mounted 96 in. (2.4 cm) above Floor |

-continued

| Test | ANSI/UL 1254-1999 Class B Section 26.6 and 26.7 |
|---|---|
| Fuel | 2.5 $ft^2$ (0.2 $m^2$) pan with heptane |
| Pre Burn Time | 0:27 (min:sec.) (automatic discharge) |
| Time to Extinguish from Discharge | 0:02 (min:sec.) |

The results were deemed acceptable to FM Approvals.

E. One year Leakage Test (AMSI/UL 1254-1999 Section 37)

Two representative samples of the Model CFF 800 dry chemical automatic extinguishing system were charged with 16 lbs. 0.16 lbs. (7.3 kg.±0.07 kg.) of extinguishing agent to their operating pressure of 175 psig (1200 kPA). The samples were then stored at a temperature of 72° F. (22° C.) for a period of twelve months. Their weight and pressures were monitored on a monthly basis with no significant changes recorded. The results were deemed acceptable to FM Approvals.

F. 30 Day Elevated Temperature Leakage Test (ANSI/UL 1254-1999 Section 33)

Three representative samples of the Model CF 800 dry chemical automatic extinguishing system were charged with 16 lbs. 0.16 lbs. (7.3 kg.±0.07 kg) of extinguishing agent and to their operating pressure of 175 psig (1200 kPa). The samples were then stored at a temperature of 100° F. (38° C.) for a period of 30 days. Their weight and pressures was recorded at the start of testing ad after 30 days, with no significant changes recorded. The results were deemed acceptable to FM Approvals.

G. 30 Day Minimum Temperature Leakage Test

Three representative samples of the Model CFF 800 dry chemical automatic extinguishing system were charged with 16 lbs 0.16 lbs. (7.3 kg±0.07 kg.) of extinguishing agent and to their operating pressure of 175 psig (1200 kPa). The samples were then stored at a temperature of 32° F. (0.0° C.) for a period for 30 days. Their weight and pressures was recorded at the start of testing and after 30 days. With no significant changes recorded. The results were deemed acceptable to FM Approvals.

H. Salt Fog Corrosion Test (ANSI/UL 1254-1999 Section 35)

One empty Model CFF 800 dry chemical automatic extinguishing system was visually inspected prior to the salt fog testing and no defects were found in the pain coating. Following the inspection, the sample system was filled with tap water and exposed to the standard salt spray test as specified by ASTM B 117 using a 20 percent salt solution for a period of 10 days. Following the exposure period and a drying period of 2 days, a visual inspection was conducted. The inspection indicated no deterioration of the pain coating on the system. After visual inspection the Model CFF 800 automatic extinguishing system was then pressurized with air through the gas fill port. The Model CFF 800 was then mounted in a pendent position and sprinkler was activated with a suitable heat source and discharged to insure proper functionality. The results were deemed acceptable to FM Approvals.

I. Salt Fog Corrosion Test (ANSI/UL 1254-1999 Section 35)

One high pressure switch (95 psi (650 kPa)] and one low pressure switch [35 psi (240 kPa)] were individually visually inspected prior to the salt fog testing and no defects were found. Following the inspection, the sample switches were exposed to the standard salt spray test as specified by ASTM B 117 using a 20 percent salt solution for a period of 10 days. Following the exposure period and a drying period of 2 days, a visual inspection was conducted. The inspection indicated no severe deterioration or impending component failure. After the visual inspection, the samples were individually mounted on a dead weight tester and the pressure was increased until the "normally closed" or "normally opened" electrical contacts were activated. All samples properly and were deemed acceptable to FM Approvals.

J. Pressure Switch Sensitivity

After a visual examination of a sample high pressure switch [95 psi (650 kPa)] was conducted, the pressure switch was mounted on a dead weight tester and the pressure was increased until the "normally closed" or "normally opened" electrical contacts were activated. The sample functioned properly and was deemed acceptable to FM Approvals.

K. Elevated Temperature Pressure Switch Sensitivity

After a visual examination of a sample low pressure switch [35 psi (240 kPa)] was conducted, the pressure switch was individually mounted on a dead weight tester and the pressure was increased until the "normally closed" or "normally opened" electrical contacts were activated. The sample was then placed in a thermal chamber of 100° F. (38° C.) for four hours. Following the thermal equalization, the sample was mounted on a dead weight tester and the pressure was increased until the "normally closed" nor "normally opened" electrical contacts were activated. The sample functioned properly and was deemed acceptable to FM Approvals.

L. Reduced Temperature Pressure Switch Sensitivity

After a visual examination of a sample low pressure switch [35 psi (240 kPa)] was conducted, the pressure switch was individually mounted on a dead weight tester and the pressure was increased until the "normally closed" or "normally opened" electrical contacts were activated. The sample was then placed in a thermal chamber of 32° F. (0.0° C.) for four hours. Following the thermal equalization, the sample was mounted on a dead weight tester and the pressure was increased until the "normally closed" or "normally opened" electrical contacts were activated. The sample functioned properly and was deemed acceptable to FM Approvals.

M. 500 Cycle Test—Pressure Switch

After a visual examination of a sample low pressure switch [95 psi (650 kPa)] was conducted, the pressure switch was individually mounted on a dead weight tester and the pressure was increased until the "normally closed" or "normally opened" electrical contacts were activated. The sample was then mounted on a 1 in. (2.5 cm) water supply line and cycled between 5 psi (35 kPa) and 175 psi (1200 kPa) for 500 cycles. Following the cycle test, the sample was mounted on a dead weight tester and the pressure was increased until the "normally closed" or "normally opened" electrical contacts were activated. The sample functioned properly and was deemed acceptable to FM Approvals.

N. Dielectric Strength Test-Pressure Switch

After a visual examination of two low pressure switches [35 psi (240 kPa)] was conducted the pressure switches were individually mounted on a voltage tester and a voltage if 1480 V, 60 Hz was applied for 1 minute between the "normally closed", "normally opened" and ground terminals and the accessible metal parts of the switch. No arcing or dielectric breakdown resulted during this test. The results were deemed acceptable to FM Approvals.

O. Hydrostatic Pressure Test

The agent storage cylinder was visually examined and subjected to DOT Class 4B hydrostatic pressure test to measure percentage of permanent expansion of 350 psi (2412 kPa) and 700 psi (4825 kPa). The results were deemed acceptable. The DOT hydrostatic testing was performed at shipman's Fire Equipment Co. Inc of Waterford Conn. The following components were also subjected to a 700 psi (4825 kPa) hydrostatic test for one minute.

| Part Number | Part Description |
|---|---|
| CF-600 | DDI Cylinder |
| CF-700 | Coupling |
| CF-900 | Sprinkler (155° F.) |
| CF-1000 | 45 Degrees Street elbow |
| CF-1100 | Tank Valve |
| CF-1200 | Low Pressure Switch-Normally Closed |
| CF-1300 | Brass Plug |
| CF-1400 | Pressure Gauge |

No leakage or physical damage was visibly apparent on any of the samples. The results were deemed satisfactory to FM Approvals.

P. Vibration Test

One representative sample of the Model CFF 800 dry chemical automatic extinguishing system was subjected to the vibration test show below. The displacement was in a vertical axis. The Model CFF 800 was mounted to a Unistrut beam as specified in the Cease Fire installation instructions. No resonant frequencies were detected in any of the tests.

| Displacement inches (mm) | Frequency cycles/sec | Time hrs |
|---|---|---|
| 0.02 (0.51) | 28 | 5 |
| 0.04 (1.02) | 28 | 5 |
| 0.15 (3.81) | 28 | 5 |
| 0.04 (1.02) | 18 to 37 variable | 5 |
| 0.07 (1.78) | 18 to 37 variable | 5 |

The results were deemed satisfactory to FM Approvals.

Q. Physical Examination

A physical examination of the sprinkler was conducted. The sprinkler is currently FM Approved. A physical examination of the pressure gage was conducted. No additional testing beyond that specified above was necessary. The pressure gauge was deemed acceptable to FM Approvals.

We claim:

1. A method for automatically extinguishing fires which is compliant with ANSI/UL 1254 1999 for both Total Flooding and local applications in large volume spaces ("UL 1254"), comprising:

providing an enclosure comprising a large volume space of at least about 512 $ft^3$ including a ceiling having an elevated height;

providing a closed, self-contained fire extinguishing system which is compliant with UL 1254 for both total flooding and local applications (spot protection) including a container, a mixed phase agent stored within the confines of said container and an upwardly-facing, concave-shaped member attached to said container and extending outwardly from the fire extinguisher system for directing a flow trajectory of the mixed phase agent from within the container in an upward and outward lateral direction for extinguishing said fires, said UL 1254 defining (a) "total flooding" as totally flooding of the entire large volume space of the enclosure so that a fire located anywhere there within is extinguished, and (b) "local applications" (spot protection) as extinguishing a fire located below the fire extinguishing system, said mixed phase agent including (a) a fire extinguishant liquified gas which is EPA compliant, (b) a fire extinguishing powder material, (c) a polymeric gelling agent that interacts with fire extinguishing substances (a) and (b) to form a stable, gel-like suspension thereof under pressure, and (d) a viscosity reducing agent comprising microscopic glass spheres and a pressurized inert gas to facilitate the optimum discharge of fire extinguishing substances (a) and (b) from the fire extinguisher system which facilitates the flow of the mixed phase agent from the extinguisher so that substantially all of the fire extinguishing substances (a) and (b) is discharged from within the fire extinguisher system to extinguish a fire in an automatic mode in compliance with UL 1254;

securely attaching said fire extinguishing system to the ceiling at said elevated height in said enclosure in an inverted, fixed position;

automatically discharging substantially all of said mixed phase agent from the fire extinguishing system and forming a dry chemical fire extinguishing agent including the fire extinguishing substances (a) and (b) in said enclosure in response to heat generated by a fire anywhere within said large volume space; and directing the dry chemical fire extinguishing agent in an upward and lateral trajectory in a predetermined path by said concave-shaped member so that a fire located anywhere within said large volume space will be contacted by both a fire extinguishant gas and the fire extinguishing powder material of the fire extinguishing agent and will be extinguished, employing either one of (a) total flooding and (b) both total flooding and local applications in compliance with UL 1254, and wherein said container will remain intact after said fire is extinguished.

2. The method of claim 1, wherein the container includes an attachment member for affixing said fire extinguishing system to said ceiling at an elevated height in an enclosure in an inverted, fixed position with the concave-shaped member extending in a downwardly facing direction.

3. The method of claim 1, wherein the container comprises a substantially cylindrical shape.

4. The method of claim 1, wherein the container comprises a substantially cylindrical shape with a substantially rounded bottom portion.

5. The method of claim 1, wherein the fire extinguishing substances (a) and (b) discharged from the fire extinguisher system container are non-toxic.

6. The method of claim 1, which extinguishes fires in chemical materials.

7. The method of claim 1, which further includes a heat-activated apparatus for automatically discharging fire extinguishing substances (a) and (b) in an upward and outward lateral direction in response to heat generated by the fire in an area proximate to said fire extinguisher system.

8. The method of claim 1, wherein said microscopic spheres are hollow.

9. The method of claim 1, wherein the fire extinguishing material is an ammonium fire extinguishing material.

10. The method of claim 1, which extinguishes fires in electrical materials.

11. A method for automatically extinguishing fires which is compliant with ANSI/UL 1254 1999 for both Total Flooding and local applications in large volume spaces ("UL 1254"), comprising:

providing an enclosure comprising a large volume space of at least about 512 $ft^3$ including a ceiling having an elevated height;

providing a closed, self-contained fire extinguishing system which is compliant with UL 1254 for both total flooding and local applications (spot protection) including a container, a mixed phase agent stored within the confines of said container, and a concave-shaped member extending outwardly from the fire extinguisher system for directing a flow trajectory of the mixed phase agent upwardly and outwardly from within the container, said UL 1254 defining (a) "total flooding" as totally flooding of the entire large volume space of the enclosure so that a fire located anywhere therewithin is extinguished, and (b) "local applications" (spot protection) as extinguishing a fire located below the fire extinguishing system, said mixed phase agent including (a) a fire extinguishant liquified gas which is EPA compliant, (b) a fire extinguishing powder material, (c) a polymeric gelling agent that interacts with fire extinguishing substances (a) and (b) to form a stable, gel-like suspension thereof under pressure, and (d) a viscosity reducing agent comprising microscopic glass spheres which facilitates the flow of the mixed phase agent from the extinguisher so that substantially all of the fire extinguishing substances (a) and (b) is discharged from within the fire extinguisher system to extinguish a fire in chemical materials and wood in an automatic heat activated mode in compliance with UL 1254;

securely attaching said fire extinguishing system to the ceiling at said elevated height in said enclosure in an inverted, fixed position with the concave-shaped member extending in a downwardly facing direction for directing the fire extinguishing substances in an outward and upward path;

automatically discharging substantially all of said mixed phase agent from the fire extinguishing system in response to heat activation and forming a dry chemical fire extinguishing agent including the fire extinguishing substances (a) and (b) in said enclosure in response to heat generated by a fire anywhere within said large volume space; and directing the dry chemical fire extinguishing agent in an upward and outwardly and upwardly lateral trajectory in a predetermined path by said concave-shaped member wherein a fire located anywhere within said large volume space will be contacted by both a fire extinguishant gas and the fire extinguishing powder material of the fire extinguishing agent and will be extinguished, employing either one of (a) total flooding and (b) both total flooding and local applications in compliance with UL 1254, and wherein said container will remain intact after said fire is extinguished.

12. The method of claim 11, wherein said fire extinguishant liquified gas is a fluoroalkane composition.

13. The method of claim 11, which further includes a pressurized inert gas, at a pressure of at least about 150 psi, to facilitate the optimum discharge of fire extinguishing substances (a) and (b) from the fire extinguisher system.

14. The method of claim 11, wherein said microscopic spheres have a size distribution of from about 10 to 100 microns.

15. The method of claim 11, wherein said microscopic spheres are rated to withstand applied pressure of at least about 200 psi.

16. The method of claim 11, which comprises a biphasic mixture which is thixotropic.

17. The method of claim 11, wherein the trajectory of the fire extinguishing substances (a) and (b) from the fire extinguisher system to extinguish a fire is directed upwardly so it reaches a height at least equal to a point at least about 6" to 9" above the lowest point of the extinguisher system.

18. The method of claim 11, wherein said microscopic spheres are hollow.

19. The method of claim 11, which comprises a biphasic mixture which is thixotropic.

20. The method of claim 11, wherein the trajectory of the fire extinguishing substances (a) and (b) from the fire extinguisher system to extinguish a fire is directed laterally in an upwardly and outwardly direction so it reaches a height at least equal to a point at least about 6" to 9" above the lowest point of the extinguisher system.

21. The method of claim 11, which extinguishes fires in chemical materials.

22. The method of claim 11, which extinguishes fires in electrical materials.

* * * * *